United States Patent [19]

Hendy

[11] Patent Number: 4,925,342

[45] Date of Patent: May 15, 1990

[54] WATER MANAGEMENT SYSTEM

[75] Inventor: Daniel M. Hendy, Cincinnati, Ohio

[73] Assignee: Site Masters, Inc., Cincinnati, Ohio

[21] Appl. No.: 335,776

[22] Filed: Apr. 10, 1989

[51] Int. Cl.[5] ..... E02B 11/00

[52] U.S. Cl. ..... 405/45; 405/36; 405/43; 52/169.5; 52/169.14

[58] Field of Search ..... 405/36, 43, 45, 48, 405/49, 50; 52/169.5, 169.14

[56] References Cited

U.S. PATENT DOCUMENTS

| | | | |
|---|---|---|---|
| 2,158,952 | 5/1939 | Timberlake | 47/1 |
| 3,283,518 | 11/1966 | Toffolon | 405/258 |
| 3,656,690 | 4/1972 | Hanig | 238/2 |
| 4,044,179 | 8/1977 | Haas | 428/17 |
| 4,268,993 | 5/1981 | Cunningham | 47/58 |
| 4,296,884 | 10/1981 | Luebke | 238/2 |
| 4,309,855 | 1/1982 | Pate et al. | 52/169.5 |
| 4,462,184 | 7/1984 | Cunningham | 47/58 |
| 4,486,986 | 12/1984 | Cosenza | 52/169.5 |
| 4,497,853 | 2/1985 | Tomarin | 428/17 |
| 4,538,387 | 9/1985 | Barnett et al. | 52/169.5 |
| 4,574,541 | 3/1986 | Raidt et al. | 405/45 X |
| 4,639,165 | 1/1986 | Flecknoe-Brown | 405/45 |
| 4,662,778 | 5/1987 | Dempsy | 404/35 |
| 4,679,963 | 7/1987 | Heath | 405/36 |
| 4,840,515 | 6/1989 | Freese | 405/45 |

FOREIGN PATENT DOCUMENTS 2422772 12/1979 France .

*Primary Examiner*—Dennis L. Taylor
*Assistant Examiner*—Arlen L. Olsen
*Attorney, Agent, or Firm*—George P. Brandenburg

[57] ABSTRACT

An improved water management system capable of application upon existing surfaces or beneath grade of existing surfaces comprising a system of enclosing borders, a first layer of a geocomposite drainage means covered with a water pervious geosynthetic filter fabric. A second layer of resilient material is placed above the first layer and said second layer is of sufficient depth to provide support or cushion for the user as required. Said second layer of resilient material terminates near the upper surface of the enclosing borders.

17 Claims, 4 Drawing Sheets

FIG. 1
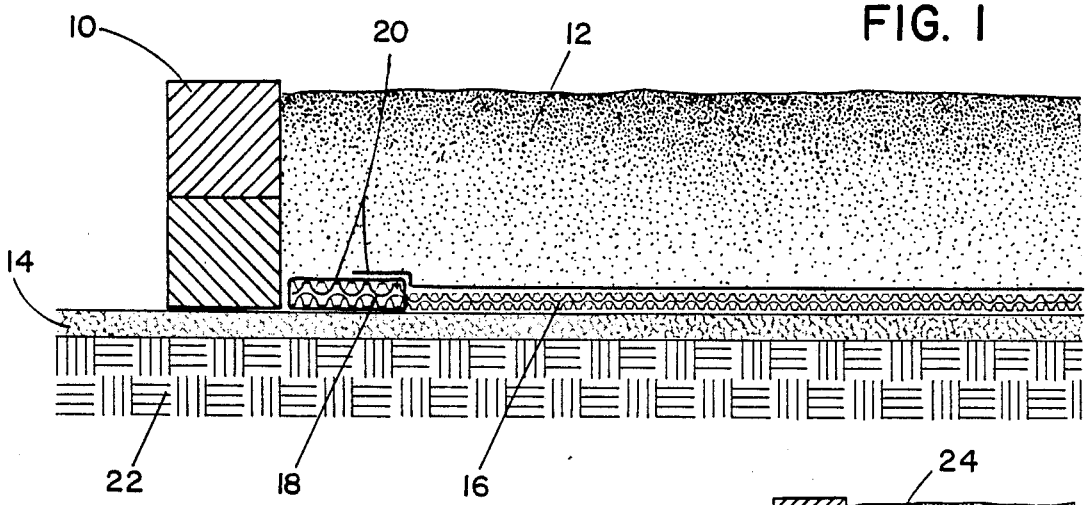
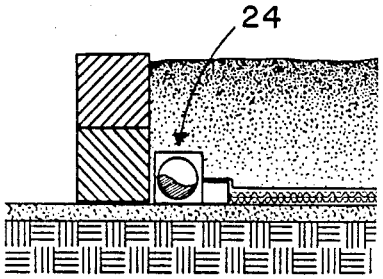
FIG. 1a
FIG. 2
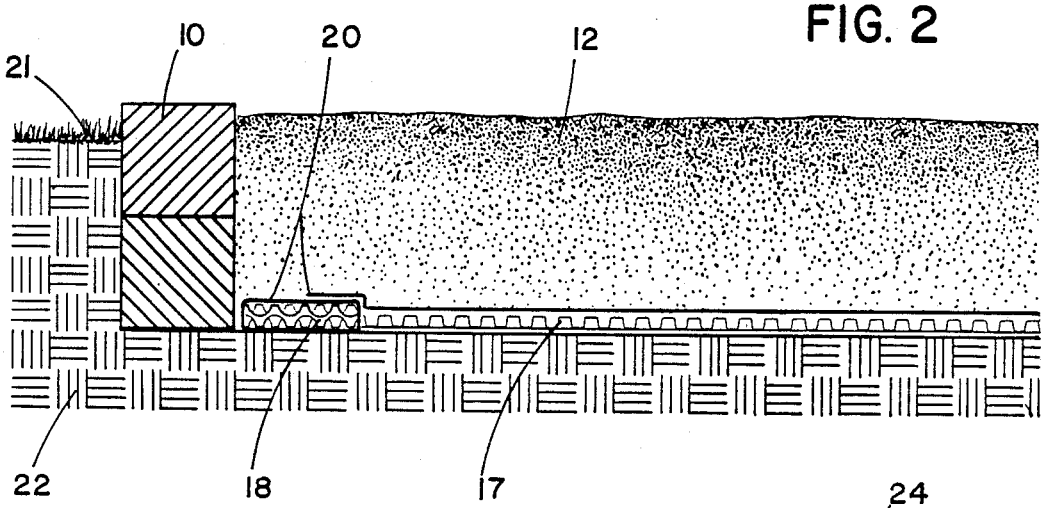
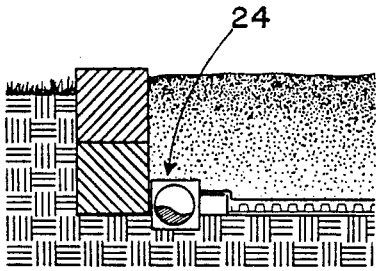
FIG. 2a

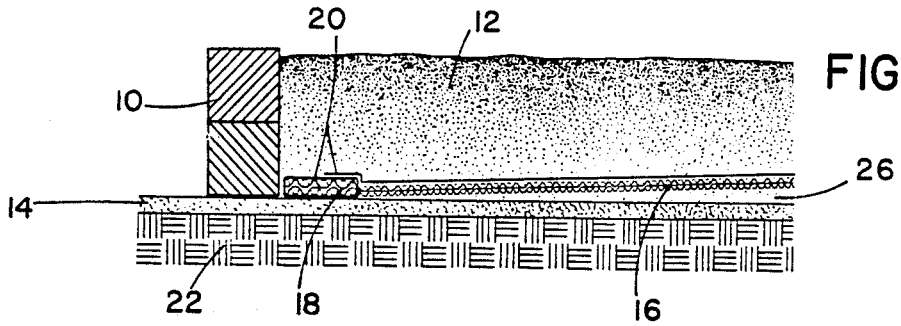
FIG. 3
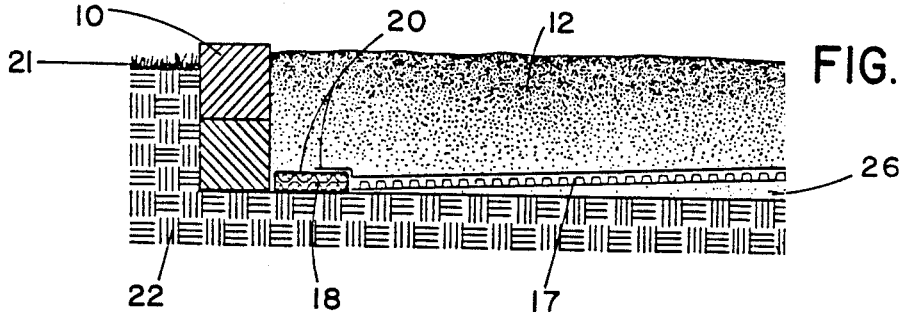
FIG. 3a
FIG. 4
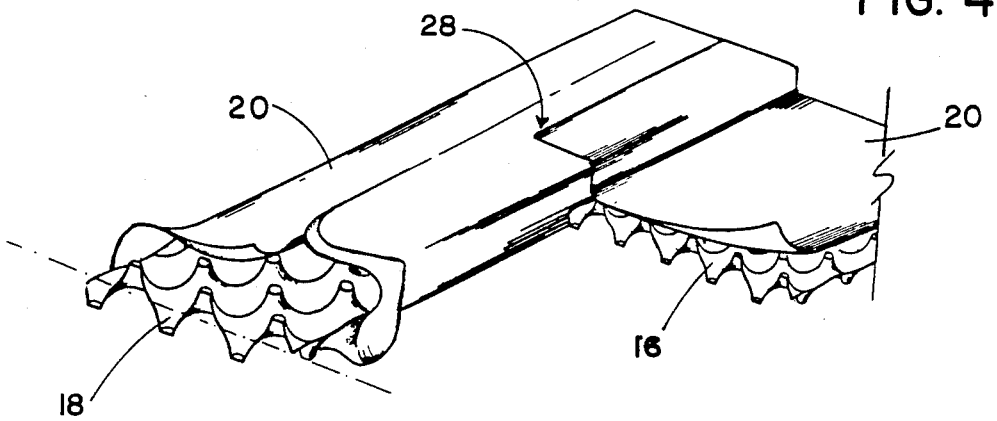
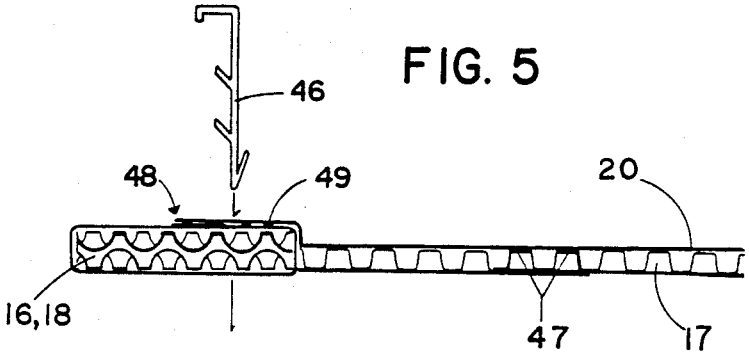
FIG. 5
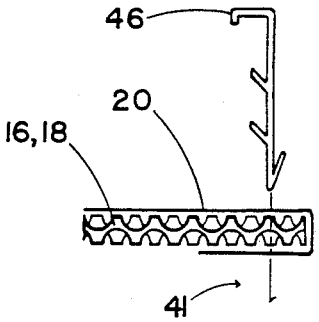
FIG. 5a

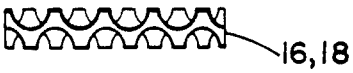
FIG. 6
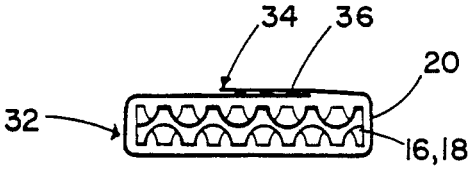
FIG. 6a
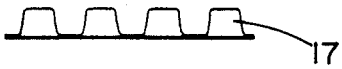
FIG. 7
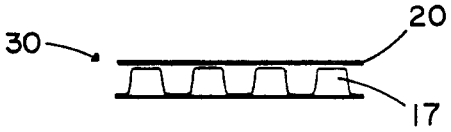
FIG. 7a
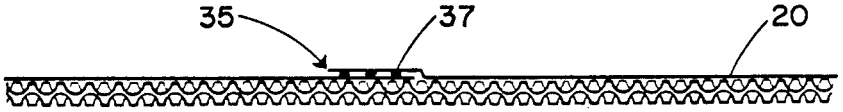
FIG. 8
FIG. 9
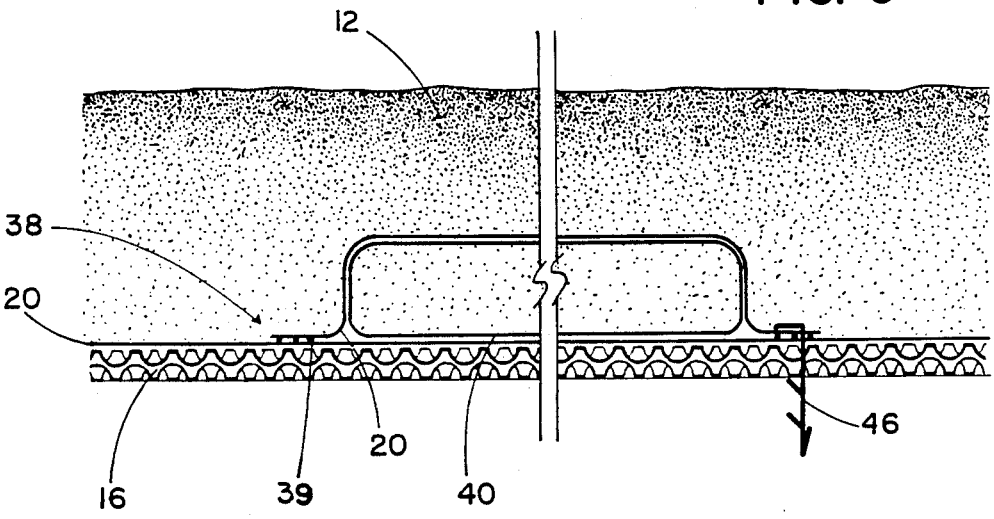

FIG. 10
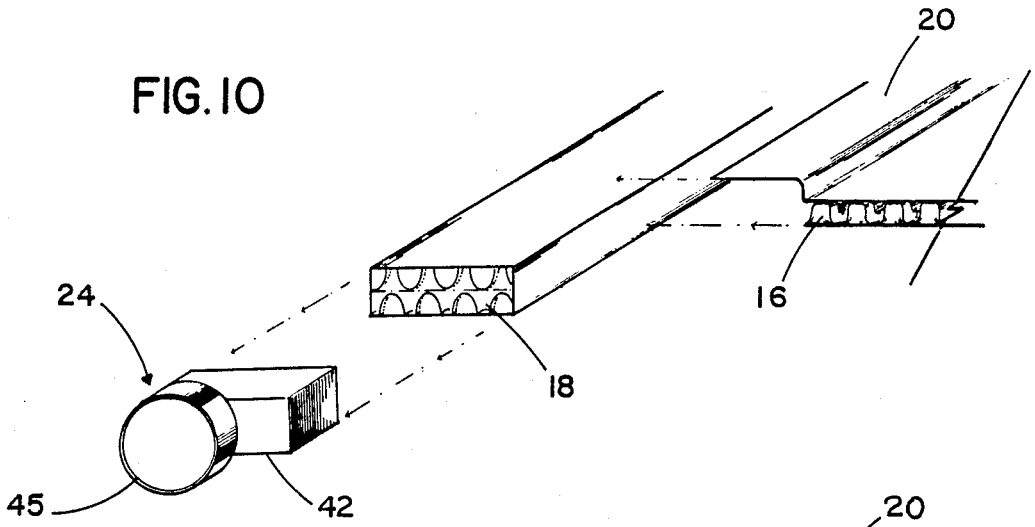
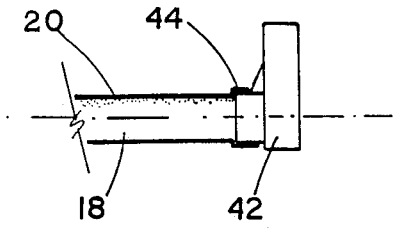
FIG. 10a
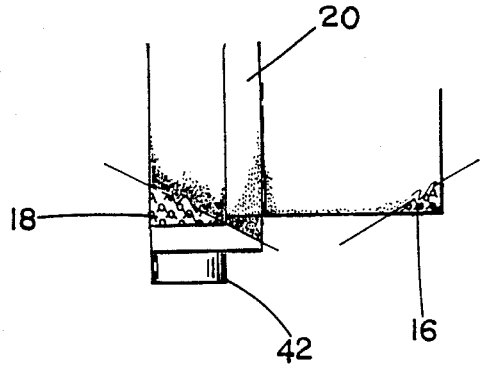
FIG. 10b

WATER MANAGEMENT SYSTEM

This invention relates to an improved water management system, and, more particularly, to a water management system which is readily adaptable to application in a variety of systems, including but not limited to, playground areas, playfields, animal storage areas, roadbeds and other high traffic or work areas which require an effective water management system to assure their continued effective use.

BACKGROUND OF THE INVENTION

Relatively few high traffic or high use areas such as playgrounds, horse stables etc. address the problem of water management, or specifically the removal of water to assure long life and effective use of the mentioned areas.

Further, the current systems provided do not address the total problem of providing not only an effective water management system, but a total system to provide a traffic or use area capable of providing a safe, economical, long life, low maintenance system.

The prior art has described systems with a limited capability to provide such a system. However, none have shown a system universally capable of use on such a wide variety of applications.

SUMMARY OF THE INVENTION

It is a principal object of the present invention to provide an improved water management system for application to a number of varied traffic and use areas.

A second object of the present invention is to provide such a system which is safe, economical, has an extended life, requires little or no maintenance and is easily and economically installed.

Another object of the present invention is to provide such a system which may be installed as a replacement system in such existing traffic or use areas or which may be provided as a new, first use system.

Still another object of the present invention is to provide such a system which provides for the safety of the user.

A further object of the present invention is to provide such a system with a resilient surface capable of insuring the safety of the user.

Yet another object of the present invention is to provide such a system using materials which will retain their resiliency and effectivness in all weather conditions.

Another object of the present invention is to provide such a system which provides for the total drainage of water from the resilient surface area thus prolonging the life of the surface material and minimizes the loss of resiliency due to freezing and thawing cycles of retained water.

It is another object of the present invention to provide such a system using a variety of materials in combination, including but not limited to, resilient surface materials, geocomposite materials manufactured from high density polyethelene, geosynthetic filter fabric materials, adhesives, and other materials, as required to develop the total system on an individual application basis.

These and other objects and advantages will be more fully understood from the following detailed description, the examples and the drawings, all of which are intended to be typical of, rather than in any way limiting on the scope of the present invention.

Briefly, one form of the present invention provides a water management system capable of application to an existing surface without the necessity of excavation. Such system comprises a combination of enclosing borders, a first layer of a geocomposite drainage means covered with a water pervious geosynthetic filter fabric. A second layer of resilient material is placed above the first layer and said second layer is of sufficient depth to provide support or cushion for the user as required. Said second layer of resilient material terminates near the upper surface of the enclosing borders.

BRIEF DESCRIPTION OF THE DRAWINGS

FIG. 1 is a cross-sectional view showing various elements of the water management system of the present invention.

FIG. 1A is a cross-sectional view of the water management system shown in FIG. 1 with the addition of a drain coupling.

FIG. 2 is an alternate embodiment of the water management system shown in FIG. 1.

FIG. 2A, is an alternate embodiment of the water management system shown in FIG. 1A.

Fig . 3 is an alternate embodiment of the water management system shown in FIG. 1.

FIG. 3A is an alternate embodiment of the water management system shown in FIG. 2.

FIG. 4 is a perspective view of a perimeter drain used in the present invention.

FIG. 5 is a cross-sectional view of the geocomposite, geosynthetic filter material of the present invention showing the application of a safe-stake (TM) tie-down means.

FIG. 5A is a cross-sectional view of an end portion of the geocomposite, geosynthetic filter material of the present invention showing the application of a safe-stake(TM) tie-down means.

FIG. 6 is a cross-sectional view of a double cusp geocomposite drain of the present invention.

FIG. 6A is a cross-sectional view of a double cusp geocomposite drain of the present invention with a geosynthetic filter material wrap.

FIG. 7 is a cross-sectional view of a single cusp geocomposite drain of the present invention.

FIG. 7A is a cross-sectional view of a single cusp geocomposite drain of the present invention with a geosynthetic filter material wrap.

FIG. 8 is a cross-sectional view of the geocomposite drain and geosynthetic filter wrap showing a joint overlap.

FIG. 9 is a cross-sectional view of the present invention showing the presence of internal pillows containing resilient material.

FIG. 10 is an exploded perspective view of the perimeter drain to exit drain coupling shown in FIG. 1A & 2A.

FIG. 10A is an elevation view of the perimeter drain to exit drain coupling.

FIG. 10B is a top view of the perimeter drain to exit drain coupling.

DESCRIPTION OF THE PREFERRED EMBODIMENTS

Referring now to the drawings wherein like parts have like numbers, a description of the preferred embodiments of the present invention follows.

The present invention provides an improved water management system comprising in combination a number of different materials to provide for the efficient removal of water from such areas as outdoor playgrounds, horse stables, home garden areas, roadsides, roadways, horse race tracks, etc.

In one embodiment of the present invention a water management system in shown in FIG. 1. In the disclosed system, use is made of existing terrain such as blacktop parking areas 14, similarly coated playgrounds, etc. In the absence of such pre-existing surfaces the earth itself 22 can be utilized as the base for the system of the current invention. In the use of such existing terrain, it is necessary to construct an enclosing border 10. Such border, it will be understood can be of any geometrical shape and constructed of a variety of materials, such as but not limited to, wooden timbers, railroad ties, steel retaining beams, high strength plastic beams, etc.

The system of the present invention comprises a layered combination of materials. A substantially planar, geometrically symmetrical and repeating double cusp geocomposite drain 16 constructed of high strength polyethelyne material is provided and is covered or wrapped with a water pervious geosynthetic filter fabric 20. The filter fabric 20 permits the passage of water through to the geocomposite drain while prohibiting dirt and debris from entering the drain thus ensuring its long life and efficiency.

The substantially planar, geometrically symmetrical and repeating double cusp geocomposite material may be provided with various core wavelengths. The appropriate core wavelength is selected based upon design considerations such as annual rainfall, greatest expected rainfall within a given time, time desired for drainage after rain, etc. It will be understood that all discussions relating to double cusp geocomposite material will be in relation to that which is substantially planar, geometrically symmetrical and repeating with a proper selected core wavelength to remove a given amount of water within a given time span.

The flow of water through the geocomposite material discussed is predictable with near certain repeatability, whereas flow through prior art sand and gravel systems vary significantly and predictability of flow is difficult, thus making design of adequate water management systems difficult.

A substantially planar, geometrically symmetrical and repeating double cusp geocomposite perimeter drain 18 of larger cross-sectional dimension than the double cusp geocomposite drain 16 is provided as a collector and run off for all water collected in drain 16. The perimeter drain 18 is also wrapped or covered with t he water pervious geosynthetic filter material 20. It is to be understood that the geocomposite drain may be completely wrapped or merely covered on its upper layer with the filter material 20.

A resilient material 12 is next placed over the drain material previously described. Resilient material 12 may be of various type, such as, but not limited to, special selected hardwood fiber, specified sand, rubber, etc. The preferred material is selected hardwood fiber with a specified range of dimension. Such material has a longer life, is more flame retardent, and has more resiliency than most materials.

The resilient material 12 may vary in thickness depending upon the nature of the material utilized and the selected application.

The geocomposite material 18/geosynthetic filter fabric material 20 combination, as well as the geocomposite material 16/geosynthetic filter fabric 20 combination may be provided in rolls as a single unit for later application. Such provision allows for economical installation and does not require the use of skilled mechanics.

Collected water can exit the system at any point or can be directed through an adjoining geocomposite drain, such as 18.

An alternate application of the water management system of the present invention is shown in FIG. 2. The system is shown inserted below the normal grade line 21 of earth 22. In such a use the perimeter drain area will require excavation, or use of a naturally occuring depression may be had.

A substantially planar, geometrically symmetrical and repeating single cusp geocomposite material drain 17 is disclosed in FIG. 2. It is to be understood by those skilled in the art that the use of such geocomposite material in combination with geosynthetic filter fabric material 20 may utilize such geocomposite drain material with at least one substantially planar, geometrically symmetrical and repeating cusp or more.

FIGS. 1A and 2A show the application of a drain coupling 24 which is shown in more detail in FIG. 10.

In the event a naturally occurring grade of at least 1.0% is not available, it will be desirable to provide for the existance of such a grade so that the geocomposite drain can efficiently allow for the run-off of collected water. FIGS. 3 & 3A show a grade build -up 26 to provide slope for drainage of collected water. Such grade build-up area can be developed using dirt, sand, rock or gravel or other such materials. In the event of a sub-grade application it is to be understood that the earth could be graded to provide the desired slope.

In the present invention use is made of substantially planar, geometrically symmetrical and repeating double cusp geocomposite material such as that shown in FIG. 4 and disclosed in U.S. Pat. No. 4,639,165. Double cusp geocomposite material 16 used for overall water drainage and double cusp geocomposite material 18 used for perimeter drainage and which is of a larger size that drain 16 is shown in an exploded view in FIG. 4. Also shown is the wrapping of water pervious geosynthetic filter material 20 about perimeter drain 18 and the single top covering of the water pervious geosynthetic material 20 covering drain 16.

The water pervious geosynthetic fabric is overlapped at the junction of drain 16 and perimeter d rain 18, shown generally at 28 in FIG. 4 . During installation this overlap junction is preferably glued or otherwise fastened to insure placement during use.

It is to be understood by those skilled in the art that the geocomposite material can be of the double cusp variety 16, 18 as shown in FIGS. 6 & 6A or the single cusp variety 17 shown in FIGS. 7 & 7A. Other geometrical shapes and combinations are possible, however experience has shown either the single or double cusp designs to be the most efficient.

When the single cusp geocomposite material 17 is used as shown in FIGS. 2A & 3A adjoining rows may be overlapped at least one row or more as shown at 47 in FIG. 5 to allow for an interlocking system which will insure long life and continued placement of the material within the water management system of the present invention.

As previously discussed, the single cusp geocomposite material 17/geosynthetic filter fabric material 20 may be provided in single layer covered or fully wrapped rolls for easy economical installation.

The water pervious geosynthetic filter fabric may be applied either using the single strip method covering the top portion of the geocomposite drain material as shown generally by 30 in FIG. 7A or completely enclosing the geocomposite material as shown generally at 32 in FIG. 6A. If a complete wrap 32 is utilized, an overlap junction 34 is provided and the filter fabric 20 is glued 36 in position to assure continued placement of said filter fabric material.

Similarly if two separate portions of said geocomposite material are placed adjacent to each other as shown in FIG. 8 an overlap of approximately 4 inches of the geosynthetic filter fabric material 20 is provided as shown generally at 35 and glued in place 37 to assure continued placement of said filter fabric material.

Such an overlap system is shown in FIG. 5 wherein a single layer of geosynthetic filter fabric material 20 is applied to a combination single cusp 17/double cusp 16, 18 system disclosing an overlap area 48 which is glued in place at 49.

FIG. 5A discloses the practice of wrapping the ends of the geocomposite material 16, 18 or it is to be understood single cusp geocomposite material 17, or other such geometric combinations when a single layer covering of geosynthetic filter fabric material 20 is used and the drain does not join a perimeter drain as shown as in FIG. 1. The end wrap is shown generally at 41 in FIG. 5A.

Also disclosed in FIGS. 5 & 5A is the use of a safe-stake (TM) 46 which comprises a series of controlled flexible barbs which insure placement of the stake within the drain and ground to maintain placement of the drain within the water management system of the present invention. The safe-stake (TM) is manufactured of flexible plastic, polycarbonate compound and has safe rounded corners to insure the safety of others if subsequently exposed.

It is to be understood that a system such as that described herein may require some maintenance in high traffic areas, such as playgrounds where a high concentration of activity may be experienced, i.e. swings, slides, etc. In one embodiment of the present invention a provision for such areas is provided as shown in FIG. 9. A self-contained pillow 40 of resilient material such as specified sand, wood fiber, rubber, etc. is provided in sufficient number to cover the expected high traffic areas. Said pillow 40 can be of varying size to cover the traffic area and is preferably one-third to one-half the thickness of the unrestrained resilient material 12 provided for the system of the present invention.

Pillow 40 is wrapped in plastic or other material. A covering of geosynthetic filter fabric material 38 is provided to cover said pillow and overlaps the existing geocomposite material 16/geosynthetic filter fabric material 20 system by approximately 4–6 inches on both sides and is glued as shown at 39 to assure continued placement during service.

In the alternate embodiment of the water management system of the present invention as shown in FIG. 9 the geosynthetic filter fabric material 20 requires a thickness of approximately three times that of the normal application previously discussed.

To assist the user in overall maintenance of the system and to assure that the drain system is not damaged a warning label is provided for placement upon filter cover 38 which states "Maintenance Required When This Label is Visible". The presence of Pillow 40 and the warning label described will allow for an extended life of the water management system of the present invention.

FIG. 10 is an exploded perspective view of the connection of perimeter drain 18 with exit drain 24, as shown in FIGS. 1A & 2A. In large areas where the water run-off may at times be high, or in areas where there is excessive rainfall, it may be desirable to direct collected water to existing storm or drainage systems. If such is desirable, perimeter drain 18 is inserted into drain coupling 42 which may be constructed of plastic, copper, cast iron or any other material commonly used to produce such drain parts and the collected water permitted to exit said perimeter drain through exit drain 45 which may be connected to any existing storm or sewer system available.

The described coupling is further shown in FIGS. 10A & 10B. Consistent with all other joints made in the within present invention the geosynthetic filter fabric 20 is over lapped and glued to the first portion of drain coupling 42 as shown at 44 of FIG. 10A.

Although the present invention has been described in connection with specific examples and embodiments, it will be recognized by those skilled in the art the variations and modifications of which the present invention is capable without departing from its scope as represented by the appended claims.

What is claimed is:

1. An improved water management system comprising:

(a) an enclosing border;

(b) a first drainage means comprising a geocomposite material substantially covering the lower portion formed by said enclosing border, comprising a substantially planar , geometrically symmetrical and repeating core having at least a single repeating verticle cusp extending upward from the base of said core, and enclosed by a water pervious geosynthetic filter fabric;

(c) a second drainage means comprising a geocomposite material comprising a substantially planar, geometrically symmetrical and repeating core having at least a single repeating verticle cusp extending upward from the base of said core, said second drainage means being dimensionally thicker than said first drainage means, located adjacent at least one perimeter area formed by said enclosing borders;

(d) a third drainage means comprising a layer of resilient material, said third drainage means covering said first and second drainage means and being confined within said enclosing border and terminating near the upper surface of said enclosing border;

(e) attachment means for attaching said first drainage means to said second drainage means.

2. The improved water management system of claim 1 wherein said enclosing border rests upon an existing surface such as earth or blacktop.

3. The improved water management control system of claim 1 wherein said enclosing border rests within and below an existing earth surface.

4. The improved water management control system of claim 1 including, in addition, attachment means for attaching said second drainage means to existing storm or sewer drain lines.

5. The attachment means of claim 4 comprising:

(a) drain coupling means;

(b) water exit means;

(c) attachment means for attaching said second drainage means to said drain coupling means comprising a friction fit between said second drainage means and said drain coupling means and further comprising a perimeter wrapping of water pervious geosynthetic filter fiber material about the perimeter of the joint formed by the exit end portion of the second drainage means and the entrance opening portion of said drain coupling means, said perimeter wrapping being glued to said members forming said joint.

6. The attachment means of claim 1 for attaching said first drainage means to said second drainage means including, in addition, an overlap of said geosynthetic filter fiber material at the intersection of said first and second drainage means wherein said overlap is of substantially sufficient distance to bond said drainage means together in service and further is supported in position by gluing.

7. The attachment means of claim 6 including stapling.

8. The attachment means of claim 6 including sewing.

9. The attachment means of claim 6 including hot ironing.

10. The improved water management system of claim 1, wherein:

said resilient material of third drainage means is comprised of wood fiber.

11. The improved water management system of claim 1, wherein:

said resilient material of third drainage means is comprised of rubber.

12. The improved water management system of claim 1, wherein:

said resilient material of third drainage means is comprised of specified sand.

13. An improved water management system comprising:

(a) an enclosing border;

(b) a lower portion comprising a grade of at least one degree;

(c) a first drainage means comprising a geocomposite material substantially covering the lower portion formed by said enclosing border, and said graded area, comprising a substantially planar, geometrically symmetrical and repeating core having at least a single repeating verticle cusp extending upward from the base of said core, and enclosed by a water pervious geosynthetic filter fabric;

(d) a second drainage means comprising a geocomposite material comprising a substantially planar, geometrically symmetrical and repeating core having at least a single repeating verticle cusp extending upward from the base of said core, said second drainage means being dimensionally thicker than said first drainage means, located adjacent at least one perimeter area formed by said enclosing borders, and adjacent the terminus of grade of said lower portion.

(e) a third drainage means comprising a layer of resilient material, said third drainage means covering said first and second drainage means and being confined within said enclosing border and terminating near the upper surface of said enclosing border;

(f) attachment means for attaching said first drainage means to said second drainage means.

14. An improved water management system comprising:

(a) an enclosing border;

(b) a first drainage means comprising a geocomposite material substantially covering the lower portion formed by said enclosing border, comprising a substantially planar, geometrically symmetrical and repeating core having at least a single repeating verticle cusp extending upward from the base of said core, and enclosed by a water pervious geosynthetic filter fabric;

(c) a second drainage means comprising a geocomposite material comprising a substantially planar, geometrically symmetrical and repeating core having at least a single repeating verticle cusp extending upward from the base of said core, said second drainage means being dimensionally thicker than said first drainage means, located adjacent at least one perimeter area formed by said enclosing borders;

(d) a contained portion of selected resilient material adjacent to either or both first and second drainage means and positioned so as to be in areas of high traffic volume comprising a closed enclosing means and covered by a layer of geosynthetic filter fabric material;

(e) a third drainage means comprising a layer of resilient material, said third drainage means covering said first and second drainage means and being confined within said enclosing border and terminating near the upper surface of said enclosing border;

(f) attachment means for attaching said first drainage means to said second drainage means.

15. The enclosing means of said contained portion of resilient material of claim 14 which is a thick plastic material.

16. The enclosing means of said contained portion of resilient material of claim 14 which is geosynthetic filter fabric material.

17. An improved water management system comprising:

(a) an enclosing border;

(b) a first drainage means comprising a geocomposite material substantially covering the lower portion formed by said enclosing border, comprising a substantially planar, geometrically symmetrical and repeating core having at least a single repeating verticle cusp extending upward from the base of said core, and enclosed by a water pervious geosynthetic filter fabric;

(c) a second drainage means comprising a geocomposite material comprising a substantially planar, geometrically symmetrical and repeating core having at least a single repeating verticle cusp extending upward from the base of said core, said second drainage means being dimensionally thicker than said first drainage means, located adjacent at least one perimeter area formed by said enclosing borders;

(d) a third drainage means comprising a layer of resilient material, said third drainage means covering said first and second drainage means and being confined within said enclosing border and terminating near the upper surface of said enclosing border;

(e) attachment means for attaching said first drainage means to said second drainage means.

(f) an attachment stake to secure said first and second drainage means to the lower portion of the enclosed border wherein said anchor angle comprises:

(a) a substantially straight portion having thereon a series of barbs sloping outward and upward from said straight portion;

(b) a substantially horizontal portion at the first and of said straight portion and cooperating at substantially 90 degrees with said first portion;

(c) a substantially straight portion at the opposite end of said horizontal portion, said straight portion extending downward in the same direction as said first straight portion and being substantially shorter than said first straight portion;

(d) a pointed second end of said first straight portion for ease of insertion into said drainage means and lower portion of floor formed by said enclosing borders;

(e) said attachment stake having rounded edges for safety.

* * * * *